United States Patent [19]

Pedder

[11] 4,311,730

[45] Jan. 19, 1982

[54] THICK FILM CIRCUITS

[75] Inventor: David J. Pedder, Oxford, England

[73] Assignee: Plessey Incorporated, New York, N.Y.

[21] Appl. No.: 131,910

[22] Filed: Mar. 20, 1980

[30] Foreign Application Priority Data

Mar. 21, 1979 [GB] United Kingdom ..... 09895/79

[51] Int. Cl.[3] ..... B05D 5/12

[52] U.S. Cl. ..... 427/102; 427/126.2; 427/126.3; 427/226; 427/279; 427/287; 427/376.2; 427/376.3; 427/376.6; 427/377; 427/96

[58] Field of Search ..... 427/102, 123, 126.2, 427/126.3, 226, 279, 287, 376.2, 376.3, 376.6, 377, 96; 252/518, 512

[56] References Cited

U.S. PATENT DOCUMENTS

| | | | |
|---|---|---|---|
| 3,868,334 | 2/1975 | Van Loan | 252/518 |
| 3,924,221 | 12/1975 | Winkler | 252/518 |
| 3,950,176 | 4/1976 | Deeg et al. | 252/518 |
| 3,974,304 | 8/1976 | Girard et al. | 427/162 |
| 3,976,811 | 8/1976 | De Tommasi | 427/102 |
| 4,044,173 | 8/1977 | Laurie | 252/518 |
| 4,122,143 | 10/1978 | Momotari et al. | 252/518 |

*Primary Examiner*—Norman Morgenstern
*Assistant Examiner*—Richard Bueker
*Attorney, Agent, or Firm*—Fleit & Jacobson

[57] ABSTRACT

A thick film resistor suitable for deposition on a copper printed circuit is produced by providing a resistor pattern of a mixture of metal powder and oxide of the metal and heating in a nitrogen atmosphere at a temperature such that the metal and the metallic oxide react to produce a conducting lower oxide.

3 Claims, No Drawings

THICK FILM CIRCUITS

The present invention relates to thick film circuits and more particularly to thick film resistors and to a method for the manufacture of thick film resistors.

Conventional thick film resistor and conductor systems are based upon mixtures of finely divided precious metal oxides, precious or semi-precious metals, oxide glazes and a suitable organic vehicle designed to give the resulting ink the required rheology for screen printing. During firing of the printed and dried pattern, the organic binder from the vehicle system is burnt off by the oxidising furnace atmosphere employed (normally dry, clean air) at 300° to 500° C. At a higher temperature the oxide glaze flows binding the conducting phases together and forming a dense film soundly bonded to the ceramic substrate (normally alumina). Great attention must be paid to the control of the particle size and size distribution parameters of the ingredient powders and to the composition and high temperature viscosity of the oxide glazes employed. This is especially so in the case of thick film resistor inks, based typically upon a ruthenium oxide conducting phase and a lead borosilicate glass composition.

The present invention is particularly concerned with and is to be compatible with a base-metal copper conductor system comprising finely divided copper powder a glass frit and an organic vehicle developed by Plessey Inc. E.M.D. The conductor system has to be fired in a nitrogen atmosphere to prevent oxidation of the copper conducting phase. The copper powder in the printed pattern sinters during firing to produce a high conductivity track bonded to the substrate via the glass frit.

With a base-metal nitrogen firing resistor system an immediate problem occurs in the selection of suitable conducting phase and glassy matrix compositions, since ruthenium oxide and lead borosilicate glazes suitable for air firing are readily reduced by the organic binder residues. These carbonaceous residues are not removed from the vehicle system by oxidation since an inert atmosphere is used. Reduction can lead to metallic ruthenium and lead being present in the fired film giving very poor electrical properties and inadequate wetting of the substrate. A novel solution to this problem has been found in the present invention.

The present invention provides a method of producing a thick film resistor compatible with a copper conductor including providing a pattern of a mixture on a ceramic surface said mixture comprising a metal powder and an oxide of the metal, and heating the patterned ceramic in a nitrogen atmosphere. The metal and metallic oxide react to give a conducting lower oxide.

In a preferred embodiment the metal is molybdenum and the metallic oxide is molybdenum oxide ($MoO_3$). In a further preferred embodiment small proportions of tungsten metal and/or vanadium pentoxide were added to the mixture to give a negative shift in temperature coefficient of resistance (TCR) values.

The base metal resistor system according to the present invention is comprised of a glaze and a mixture of a metal powder, in this case molybdenum, and the metal oxide, molybdic oxide ($MoO_3$) which will react at temperatures above about 650° C. in an inert atmosphere, to give the lower oxide molybdenum dioxide ($MoO_2$). This oxide is a metallically conducting phase with a resistivity of $3\times10^{-4}$ ohm cm at ambient temperature, and a positive temperature coefficient of resistivity (TCR). Molybdic oxide is also reduced by carbon to give a lower molybdenum oxide and oxides of carbon (CO and $CO_2$) at about 480° C. Thus molybdic oxide can be added to a nitrogen firing base metal resistor system for the purpose of removing the carbonaceous binder residues from the organic vehicle during the heat-up phase of a resistor firing cycle while the glass phase is still solid and the film therefore still sufficiently porous to allow escape of the gaseous carbon monoxide and/or dioxide.

This process has the advantage that the resulting reduced molybdic oxide is itself a suitable conducting phase in a nitrogen firing thick film resistor system. Thus in the present system the carbonaceous binder residue is removed by reaction with a proportion of the molybdic oxide at about 480° C., the remainder of the unreduced molybdic oxide being reduced to molybdenum dioxide by reaction with the metal powder at a higher temperature. The final resistor film then contains a mixture of molybdenum metal and molybdenum dioxide, both of which act as conducting phases.

The addition of molybdic oxide in sufficient quantity to compensate for organic binder residues, also permits the use of lead containing glazes with modest lead contents (up to about 10 mde %). This is because molybdic oxide is more readily reduced by the binder residues than the lead oxide within the glaze, thus removing the residue before reduction of the glaze can occur.

In a preferred embodiment a molybdenum metal powder of mean particle size about 0.3 μm (made by hydrogen reduction of $MoO_3$) a molybdic oxide powder of mean particle size about 0.1 μm, and a glass frit of mean particle size about 2.5 μm diameter were employed. The glass frit was a lead borosilicate composition also containing zinc oxide, calcium oxide and alumina. The organic vehicle contained a cellulose derivative addition to control rheology and, an acrylic binder, both dissolved in an organic solvent. Pastes were prepared on a triple-roll mill, with molar ratios of molybdenum oxide and metal equivalent to the dioxide, and various ratios of glass frit to molybdenum compounds with a standard amount of organic vehicle.

By suitable variation in the ratio of glass frit to molybdenum compounds a range of resistance values were obtained. The following resistance and TCR data were measured for this system!

TABLE 1

| Composition | Resistivity Ω/□/15μm | TCR ppm/°C. −40 to +125° C. |
|---|---|---|
| A | 10 | +400 |
| B | 100 | +20 |
| C | 1K | −150 |
| D | 10K | −400 |

The detailed compositions for the compounds given in Table 1 are shown in Table 2:

TABLE 2

| | Composition, % × wt | | | |
|---|---|---|---|---|
| Paste | Mo | $MoO_3$ | Glass | Organic Vehicle |
| A | 14.00 | 42.00 | 14.00 | 30.00 |
| B | 9.01 | 27.04 | 33.95 | 30.00 |
| C | 7.00 | 21.00 | 42.00 | 30.00 |
| D | 5.69 | 17.06 | 47.25 | 30.00 |

A similar set of results can be obtained using a coarser molybdic oxide material, with a mean particle size of a few microns. An excessively coarse powder however was found to give a decreased range of resistance values.

By the addition of small proportions of tungsten metal and/or vanadium pentoxide a negative shift in TCR values is obtained, and can be used to reduce the positive TCR value of the 10 $\mu/\square$ paste composition.

In a practical system printed and dried resistors were fired at 850° C. in nitrogen with a ten minute dwell at temperature and heating and cooling rates of up to 100° C./per minute. Resistivity and TCR values did not vary very significantly with a −25° C. change in firing temperature or with an increase or decrease of firing time by a factor of 2. Resistivities did not change by more than 1 percent for all compositions except the 10 $\Omega/\square$ paste ($\not>$ 2%), on dipping for 10 seconds in 60/40 SnPb solder at 240° C. The presence of fired resistor did not adversely influence the solderability of the copper conductor track.

Quantech noise figures ranged from −25 to +10 dB over the 10 to 10 K range.

Other molybdenum oxide starting compounds were also successfully employed to prepare resistive compositions. For example, the partially reduced molybdic oxide prepared by the catalysed 'spill-over' reaction of hydrogen and $MoO_3$ at below 100° C., followed by thermal decomposition of the resulting oxide bronze to a partially reduced molybdic oxide was used. Again the thermal decomposition made by reaction of nascent hydrogen from zinc and HCl with $MoO_3$ in suspension, was also used. Again molybdenum resinate was added to an $MoO_3$/Mo paste to lower the resistivity.

Other mixtures of molybdenum, molybdenum oxide and glass may be used but these should be chosen to produce suitable resistor values and also to ensure that the resultant mixture is not prone to flooding during firing.

What is claimed is:

1. A method of producing a thick film resistor compatible with a copper conductor including providing a pattern of a mixture on a ceramic surface, said mixture comprising a metal powder and an oxide of the metal, and heating the patterned ceramic in an inert gas atmosphere such that the metal and the metallic oxide react to produce a conducting layer oxide, in which the metal is molybdenum and the metallic oxide is molybdic oxide $MoO_3$).

2. A method of producing a thick film resistor as claimed in claim 1 in which the inert gas is nitrogen.

3. A method of producing a thick film resistor as claimed in claim 1 in which small proportions of tungsten metal and/or vanadium pentoxide are added to the mixture to give a negative shift in temperature coefficient of resistance values.

* * * * *